US006983698B1

(12) United States Patent
Walters et al.

(10) Patent No.: US 6,983,698 B1
(45) Date of Patent: Jan. 10, 2006

(54) SHAPED CHARGE EXPLOSIVE DEVICE AND METHOD OF MAKING SAME

(75) Inventors: William Walters, Elkton, MD (US); Daniel R. Scheffler, Belcamp, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/421,899

(22) Filed: Apr. 24, 2003

(51) Int. Cl.
*F42B 1/00* (2006.01)
*F42B 1/02* (2006.01)

(52) U.S. Cl. ..... 102/307; 102/305; 102/306; 102/476; 102/475

(58) Field of Classification Search ..... 102/305–307, 102/475–476
See application file for complete search history.

(56) References Cited

U.S. PATENT DOCUMENTS 3,276,369 A * 10/1966 Bell ..... 102/306
3,375,108 A * 3/1968 Wyman et al. ..... 102/306
3,437,036 A * 4/1969 Franzen et al. ..... 102/306
4,338,713 A * 7/1982 Christopher ..... 102/306
4,481,886 A * 11/1984 Brattstrom et al. ..... 102/476
4,627,353 A * 12/1986 Chawla ..... 102/307
4,942,819 A * 7/1990 Thoma et al. ..... 102/476
4,949,642 A * 8/1990 Wisotzki ..... 102/307
5,259,317 A * 11/1993 Lips ..... 102/307
5,394,804 A * 3/1995 Cauchetier ..... 102/476
5,509,356 A * 4/1996 Renfro ..... 102/307
5,859,383 A * 1/1999 Davison et al. ..... 102/307
6,349,649 B1 * 2/2002 Jacoby et al. ..... 102/307

FOREIGN PATENT DOCUMENTS

DE 39 32 825 A1 * 4/1991

* cited by examiner

*Primary Examiner*—Michael J. Carone
*Assistant Examiner*—Lulit Semunegus
(74) *Attorney, Agent, or Firm*—William Randolph

(57) ABSTRACT

A shaped charge explosive device which includes an axially symmetric body of explosive material, a liner lining the forward end of the body, and a detonator disposed at the bottom of the body. The liner has an apex disposed along the symmetry axis of the body and the forward end of the body contains a gas filled cavity which overlaps the apex of the liner. When the detonator detonates the explosive material, a detonation wave is produced that collapses the liner into a plurality of liner parts which are projected against an external target. The gas filled cavity shapes the detonation wave so that the detonation wave impacts the liner at the most favorable angle to transfer energy to the liner and maximize the effective penetration of the external target by the projected liner parts.

23 Claims, 15 Drawing Sheets

Charge with Air Cavity Overlapping Liner

PRIOR ART

Baseline Shaped Charge

PRIOR ART

PRIOR ART

PRIOR ART

PRIOR ART

PRIOR ART

Charge with Air Cavity Wave Shaper

PRIOR ART

Charge with Air Cavity Wave Shaper

PRIOR ART

PRIOR ART

Charge with Air Cavity Overlapping Liner

Charge with Circular Air Cavity Overlapping Liner

Charge with Modified Baseline Air Cavity Overlapping Liner

SHAPED CHARGE EXPLOSIVE DEVICE AND METHOD OF MAKING SAME

BACKGROUND OF THE INVENTION

This invention relates in general to ammunition and explosives and more particularly to a shaped charge explosive device.

Explosives and explosive devices have widespread use in military, antipersonnel, civil engineering and geological exploration applications. A vast number of factors may be varied in the control and use of such explosives and explosive devices to achieve a particular result. These factors include, among others, the design and arrangement of the component parts of such devices and the selection of the materials employed therein.

Shaped charge designs are frequently employed to provide a deep hole in a target material and to maximize crater volume. A shaped charge is usually a rotationally symmetric body of explosive material, which may be used alone or be positioned in a hollow charge casing. The charge is covered by an inverted conical liner made from a ductile metal and a detonator is located within the charge along its symmetry axis.

When the charge is detonated a detonation wave is generated causing the liner to collapse into two parts. One part bursts forward along the charge's symmetry axis as a jet of metal that travels at very high speed and penetrates the target. The other part, a metal slug, travels more slowly along the same axis, in the same direction as the preceding jet.

It has been observed that increasing the tip velocity of the jet increases the depth of penetration into many targets, including most metals and geological materials. The depth of penetration is critical for military targets and for releasing the flow of gas or oil in an oil well completion application.

Numerous factors affect the tip velocity of the jet. These include the chemical and physical properties of the materials from which the explosive device is formed as well as the geometries and relative positions of the component parts of the device and various techniques and constructions employed in assembling or constructing the device. Such techniques may include tapering the wall thickness or varying the shape of the shaped charge liner, altering the materials from which the liner is formed, varying the geometry or kind of explosive charge, or varying the geometry of or the material from which the casing is formed. Most of these prior art techniques involve major modifications to the explosive device operation, ultimately affecting the cost, ease of manufacture and transport of such devices.

Another method of improving the depth of penetration involves the use of a wave shaper. A wave shaper is a device that is positioned between the detonator and the liner to shape the detonation wave so that the wave impacts the liner at a more favorable angle, i.e., nearly normal or perpendicular to the liner. This improves the performance of the shaped charge and decreases the amount of explosive required to form a fast jet. Reducing the amount or height (with a fixed diameter round) of the explosive material can reduce the charge's length and weight. Wave shapers have been made of a variety of substances and materials, including metals, plastics, concrete and air, and may include a multitude of geometric shapes to allow proper contouring of the detonation wave.

Although conventional wave shapers are useful in shaping the detonation wave from a purely divergent wave front, such wave shapers frequently do not efficiently focus the energy of the detonation wave into contact with the shaped charge liner.

SUMMARY OF THE INVENTION

Accordingly, it is an object of the present invention to provide an improved shaped charge explosive device that efficiently focuses detonation waves.

Additionally, it is an object of the present invention to provide a shaped charge explosive device that generates an increased jet tip velocity and hypervelocity jet particles, resulting in improved penetration characteristics.

It is a further object of the present invention to provide a shaped charge explosive device which permits modification of the jet of hypervelocity metallic particles.

It is also an object of the present invention to provide a shaped charge explosive device that is cost-effective to produce and is easy to manufacture.

It is a further object of the present invention to provide a shaped charge explosive device which, while having higher penetrating capabilities than similar shaped charge explosive devices, requires a lower mass of explosive charge to achieve such results.

These and other objects of the invention are achieved in one aspect by a shaped charge explosive device which includes an axially symmetric body of explosive material, a liner lining the forward end of the body, and a detonator disposed at the rear end of the body. The liner has an apex disposed along the symmetry axis of the body and the forward end of the body contains a cavity which overlaps the apex of the liner. When the detonator detonates the explosive material, a detonation wave is produced that collapses the liner into a plurality of liner parts which are projected against an external target. The cavity shapes the detonation wave so that the detonation wave impacts the liner at the most favorable angle to transfer energy to the liner and maximize the effective penetration of the external target by the projected liner parts.

Another aspect of the invention involves a method of making a shaped charge explosive device comprising the steps of: providing an axially symmetric body of explosive material having a forward end and a rear end, lining the forward end of the body with a liner having an apex located along the symmetry axis of the body; overlapping the apex of the liner with a cavity formed in the forward end of the body, and disposing a detonator at the rear end of the body.

The shaped charge explosive device of the invention produces a jet with a higher tip velocity than a conventional round having the same or similar liner and other components. In addition to improved performance, hypervelocity jet particles of low mass preceding the main massive jet tip are generated. The production of such hypervelocity jet particles not only improves the effectiveness of the shaped charge explosive device of the invention in both military and industrial applications but also provides a means of simulating the behavior of micrometeorites in space which may be used to test the performance of the outer fuselage shells of spacecraft. Furthermore, smaller amounts of explosive charge are used to achieve the aforementioned improvements. In requiring a smaller explosive charge, the shaped charge explosive device is both less costly to produce and is more easily transported because of reduced weight. In addition, both casings (when employed) and liners of the shaped charge explosive devices of the invention typically are of conventional configurations and frequently uniform thicknesses, thereby simplifying production procedures and reducing associated costs.

Additional advantages and features will become more apparent as the subject invention becomes better understood by reference to the following detailed description when considered in conjunction with the accompanying drawings wherein:

DETAILED DESCRIPTION

Figure 1:
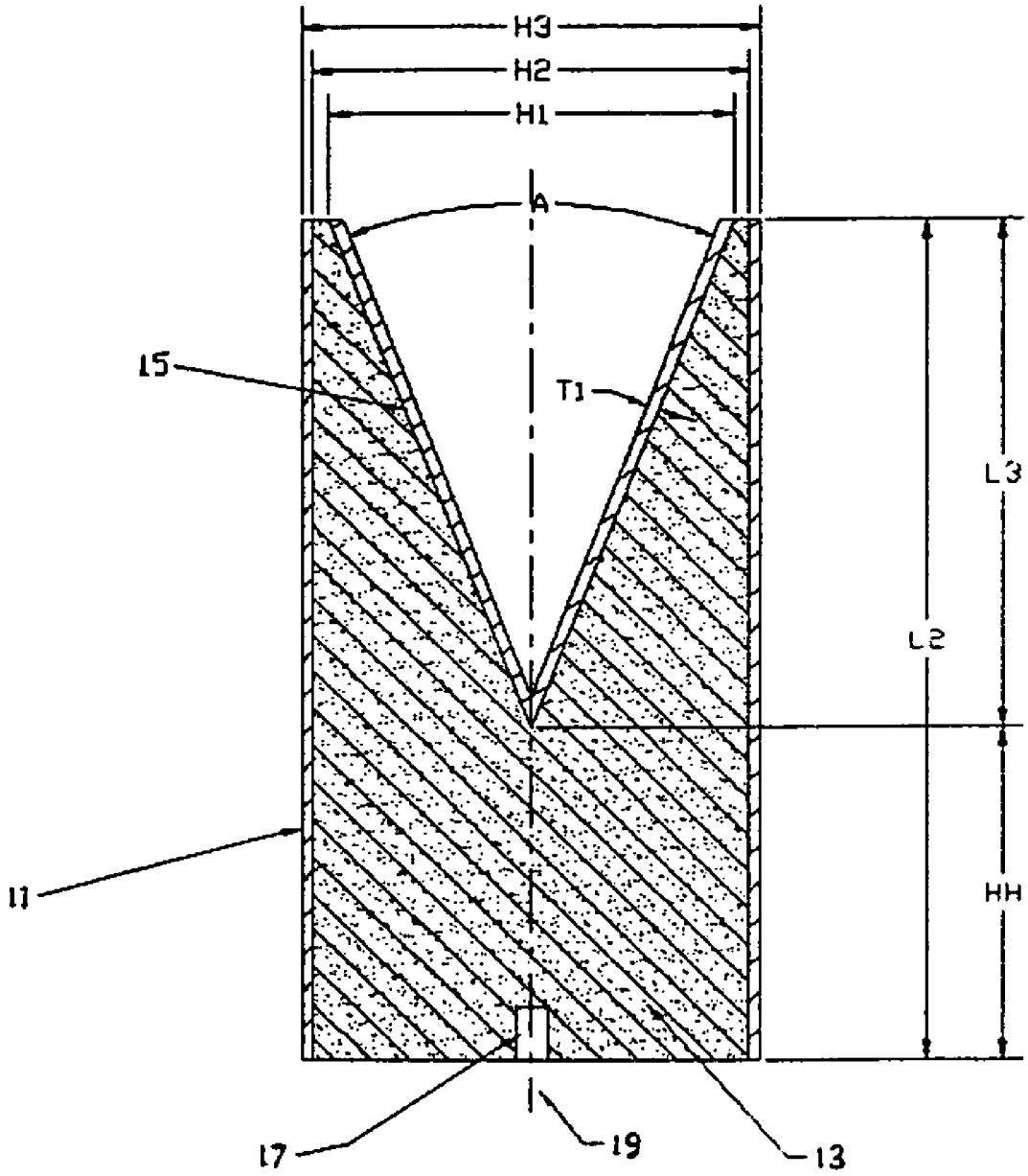
FIG. 1 is a diametral cross-sectional view of a prior art shaped charge explosive device.

Referring to the drawings, where like reference numerals designate identical and corresponding parts, FIG. 1 shows a prior art shaped charge explosive device. The device has a casing 11 containing a body of explosive material 13, although as indicated above, shaped charge explosive devices of this type may be constructed without a casing when the explosive material is formed as a solid cake. In the device of FIG. 1, a regular right circular configuration is depicted as the preferred shape of the hollow cylinder casing 11 but other forms such as tapered or boat-tailed configurations have been employed. A liner 15, preferably a hollow conical insert with a thin wall although other arcuate geometries have been used depending on the desired result, is placed within the casing 11 above the body of explosive material 13, thereby disposing the explosive material between the casing 11 and the liner 15. A detonator 17 is located rearward and is shown as coaxial with the symmetry axis 19 of the body of explosive material 13 but may be proximate to it.

In operation, the detonator 17 detonates the body of explosive material 13 generating a detonation wave causing the liner 15 to collapse into two parts. One part bursts forward along the symmetry axis 19 as a jet of metal that travels at very high speed and penetrates the target. The other part, a metal slug, travels more slowly along the same axis, in the same direction as the preceding jet.

FIGS. 2–5 are plots generated in a computer simulation of jet formation for a device like that in FIG. 1 constructed without a casing. Such computer simulations are standard practice and accurately simulate jet formation, jet stretch and growth.

Figure 2:
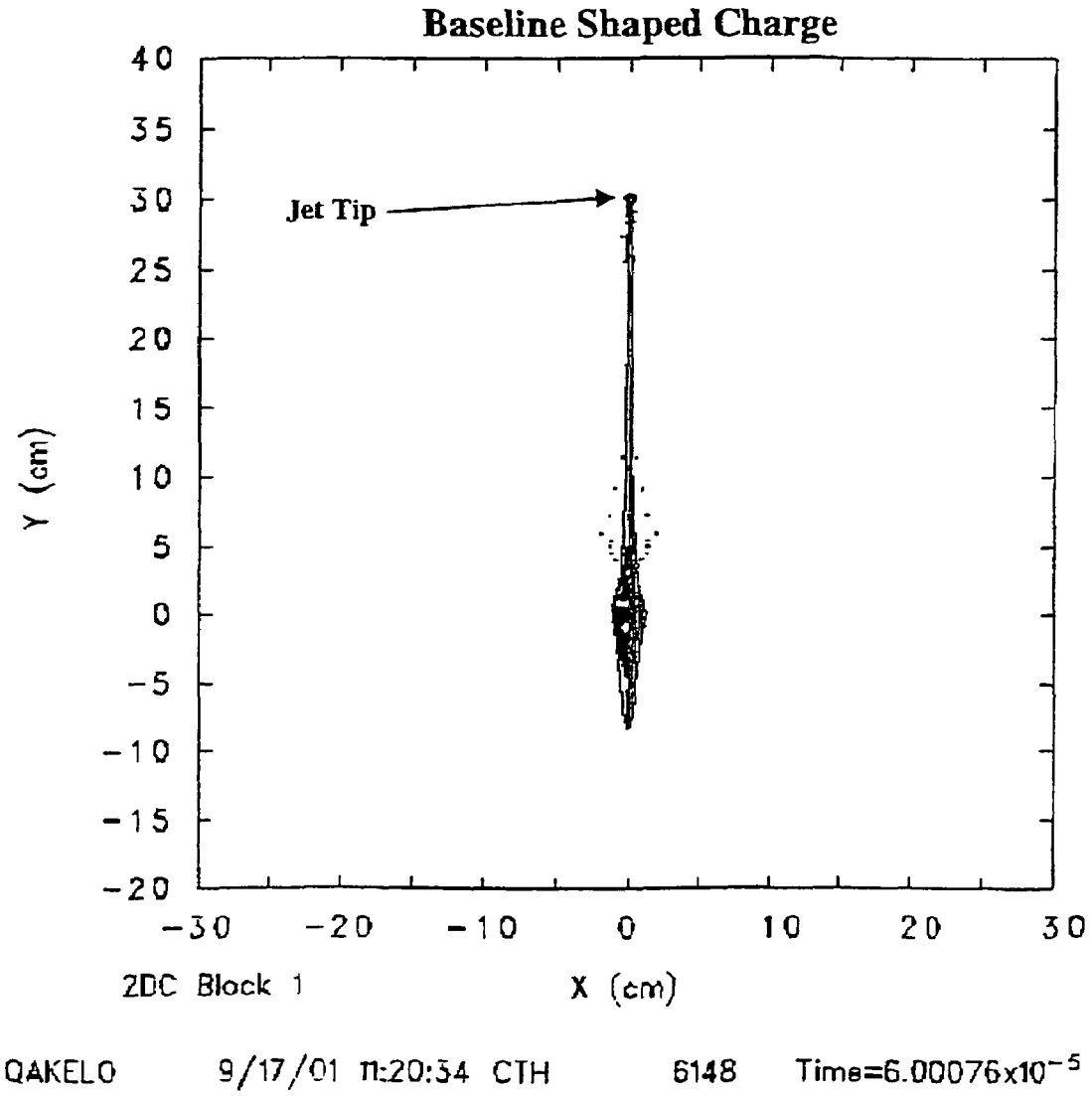
FIG. 2 is a computer simulation of the jet formation resulting from detonation of the device shown in FIG. 1.
Figure 3:
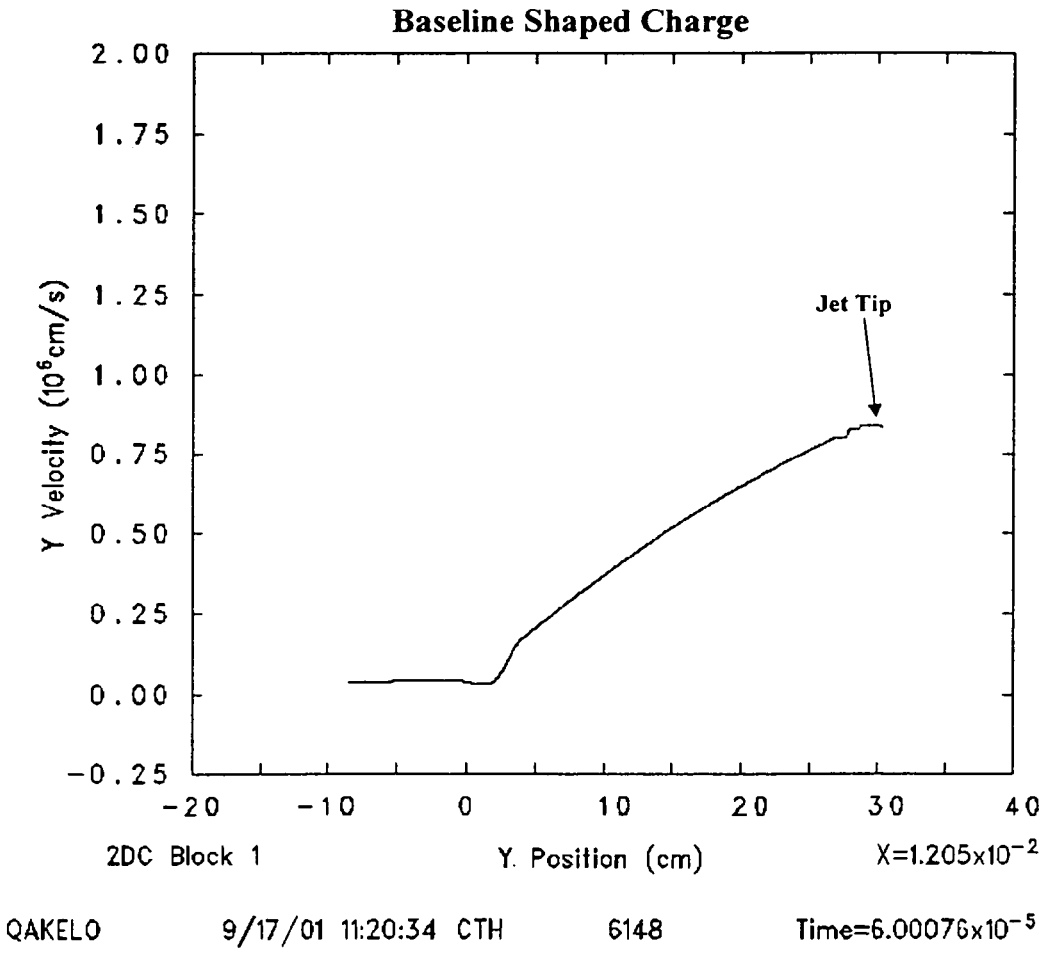
FIG. 3 is a computer simulation of a velocity profile of the jet formation resulting from detonation of the device shown in FIG. 1.
Figure 4:
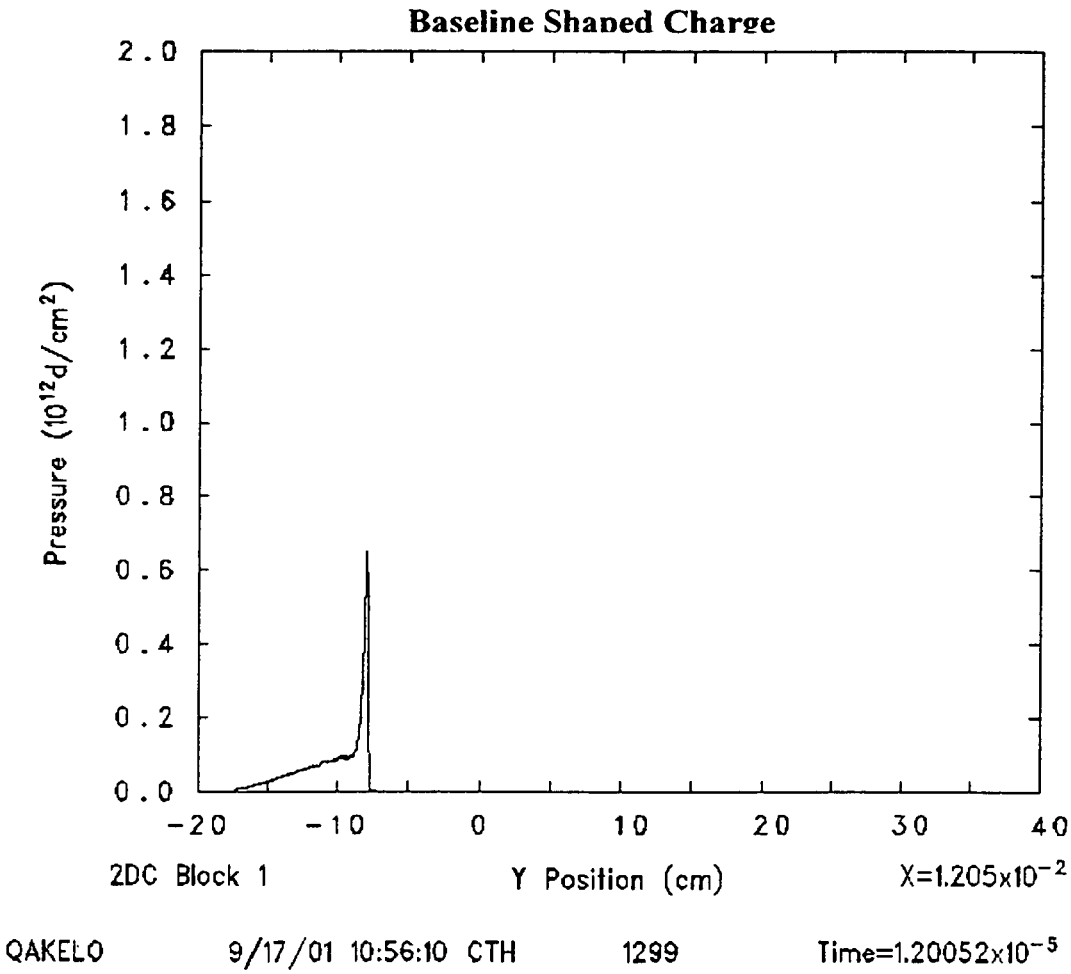
FIG. 4 is a computer simulation of a pressure profile at 12 microseconds of the jet formation resulting from detonation of the device shown in FIG. 1.
Figure 5:
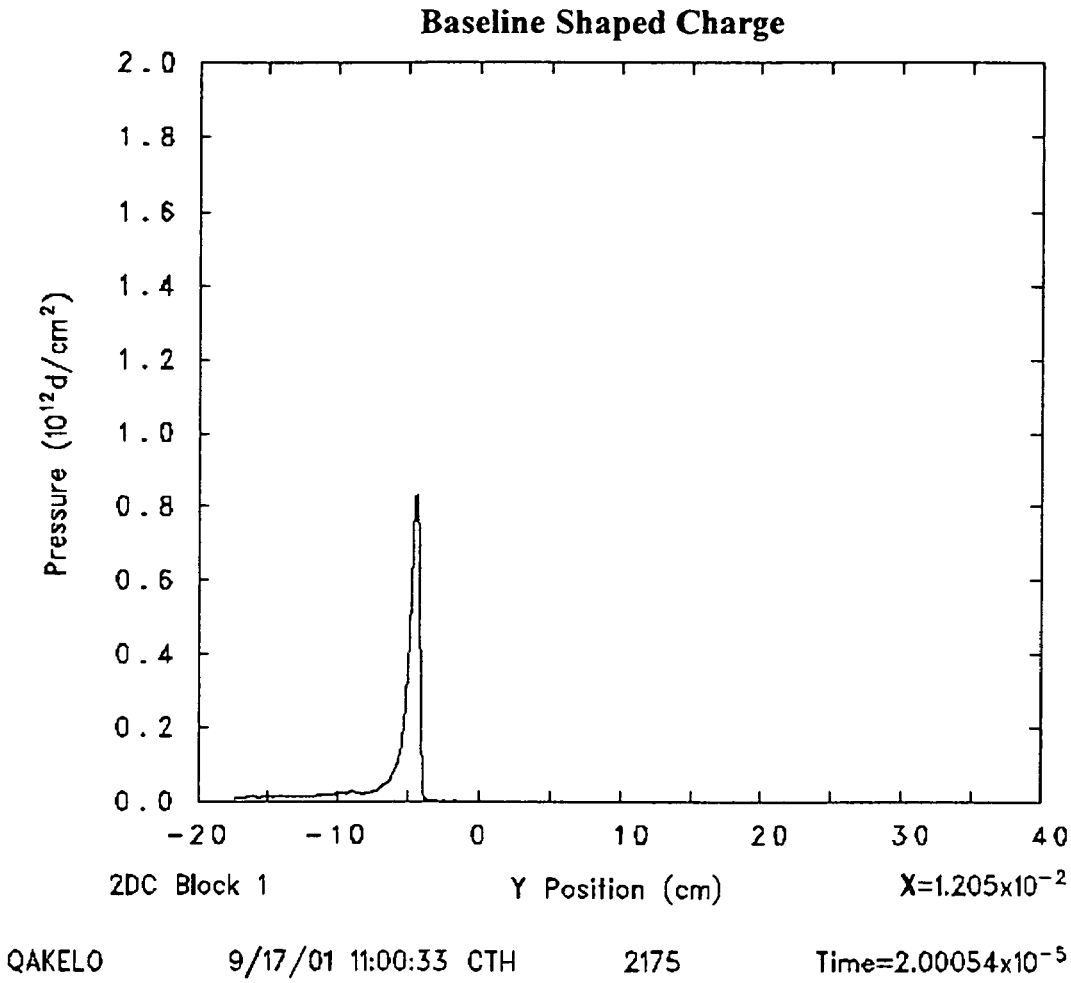
FIG. 5 is a computer simulation of a peak pressure profile at 20 microseconds of the jet formation resulting from detonation of the device shown in FIG. 1.

The actual dimensions of the elements, shown in FIG. 1 and used in the calculations of this simulation are as follows: a body of explosive material 13 having a diameter (H2) of 8.5 cm and a length (L2) of 16.14 cm, a liner 15 having an outer diameter at its base (H1) of 7.5 cm, a normal, uniform liner wall thickness (T1) of 0.225 cm, and a liner apex angle (A) of 42 degrees. The liner 15 is made from copper and the body of explosive material is a standard 1.36 kg charge of OCTOL (a standard military explosive composed of 75% HMX and 25% TNT). The body of explosive material 13 illustrated in FIG. 1 is shown as being axisymmetric, or coaxial with the axis of the liner 15. FIG. 2 is a two dimensional plot, measuring the length and width from the open end of the liner, of the jet formed in space 60 microseconds after initiation of detonation. This jet formation is conventional. The plot was generated using a CTH shock wave physics code, commonly referred to as a hydrocode (developed by Sandia National Laboratories), one of several large computer codes or programs used to simulate shock physics problems. FIG. 3 is a plot of velocity of jet particles along the jet centerline versus distance from the point of jet formation 60 microseconds after initiation of detonation. The velocity of this conventional jet tip is about 8 km/s ($8\times10^5$ cm/s). FIGS. 4 and 5 are pressure plots taken along the jet centerline at 12 and 20 microseconds, respectively. The peak pressures are $0.62\times10^{12}$ d/cm$^2$ at 12 microseconds and $0.86\times10^{12}$ d/cm$^2$ at 20 microseconds.

Figure 6:
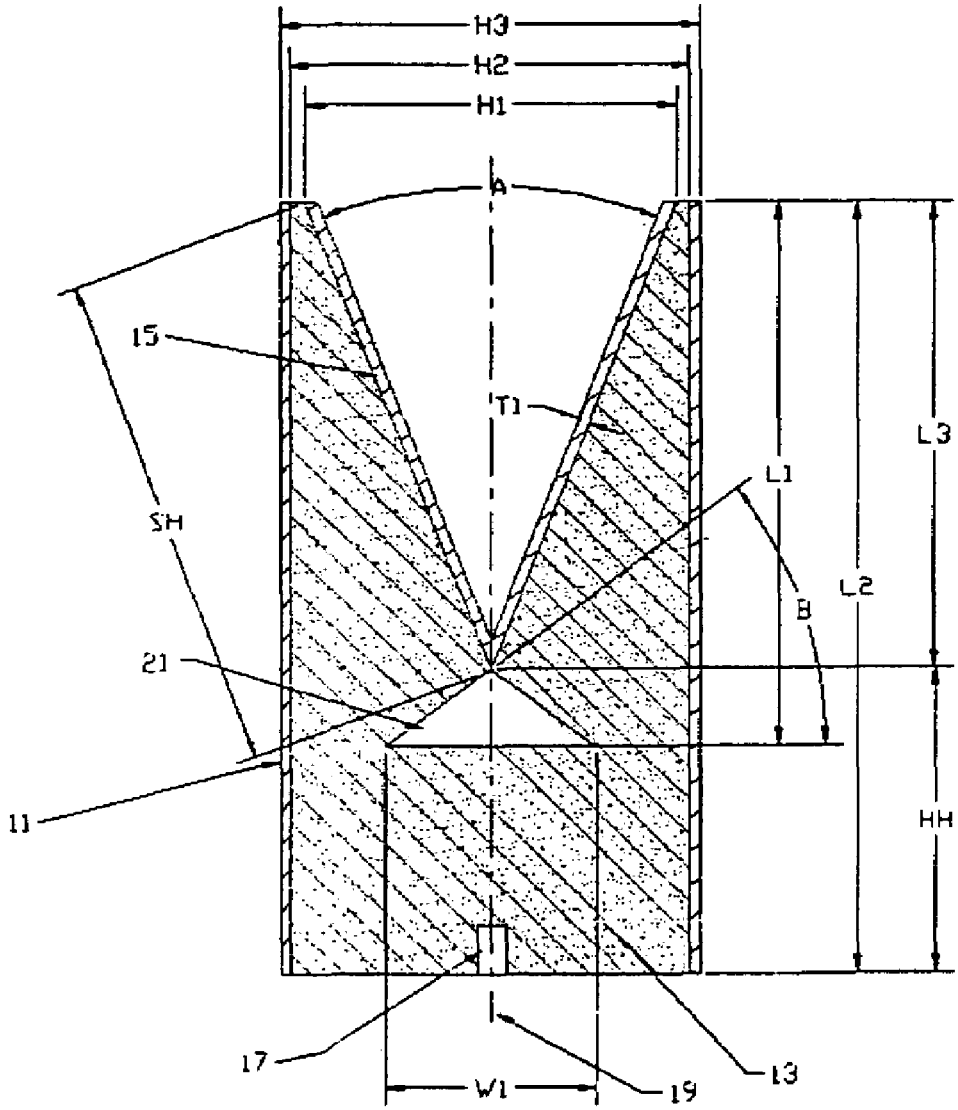
FIG. 6 is a diametral cross-sectional view of a prior art shaped charge explosive device similar to that shown in FIG. 1, additionally provided with an air cavity wave shaper.

FIG. 6 shows a prior art shaped charge explosive device that differs from the device shown in FIG. 1 by the inclusion of a wave shaper in the form of a gas-filled cavity 21 proximate the apex region of the liner 15. In this case the gas-filled cavity 21, containing air at ambient pressure, is located closer to the liner 15 apex than to the detonator 17. With other conventional wave shapers, the wave shaper is usually located closer to the detonator 17 than to the liner apex. The wave shaper interferes with and shapes the diverging detonation wave front before the detonation wave contacts the liner so that it has the proper shape to collapse the liner into a focused jet of fast moving particles.

Figure 7:
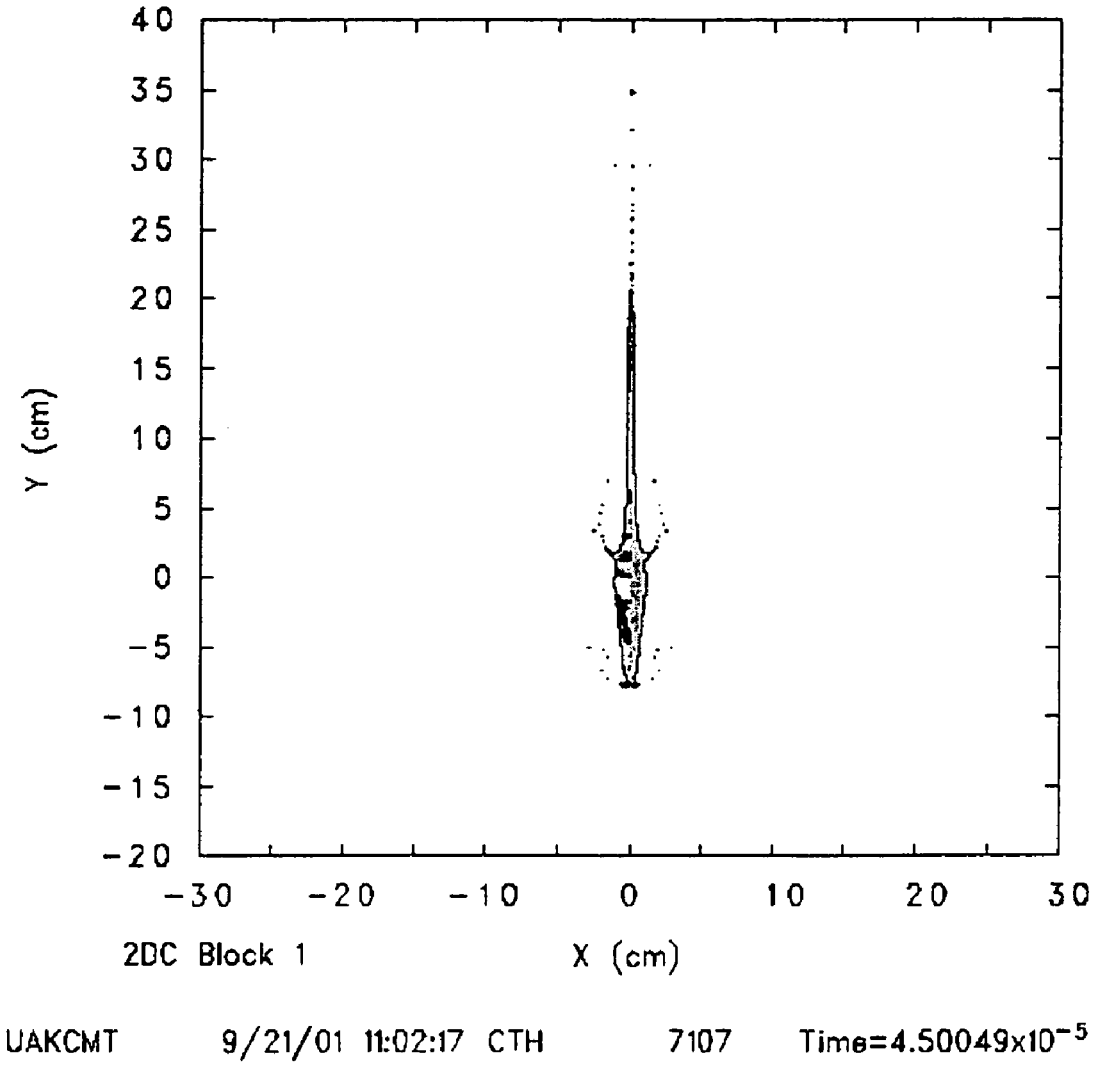
FIG. 7 is a computer simulation of a jet formation resulting from detonation of the device shown in FIG. 6.
Figure 8:
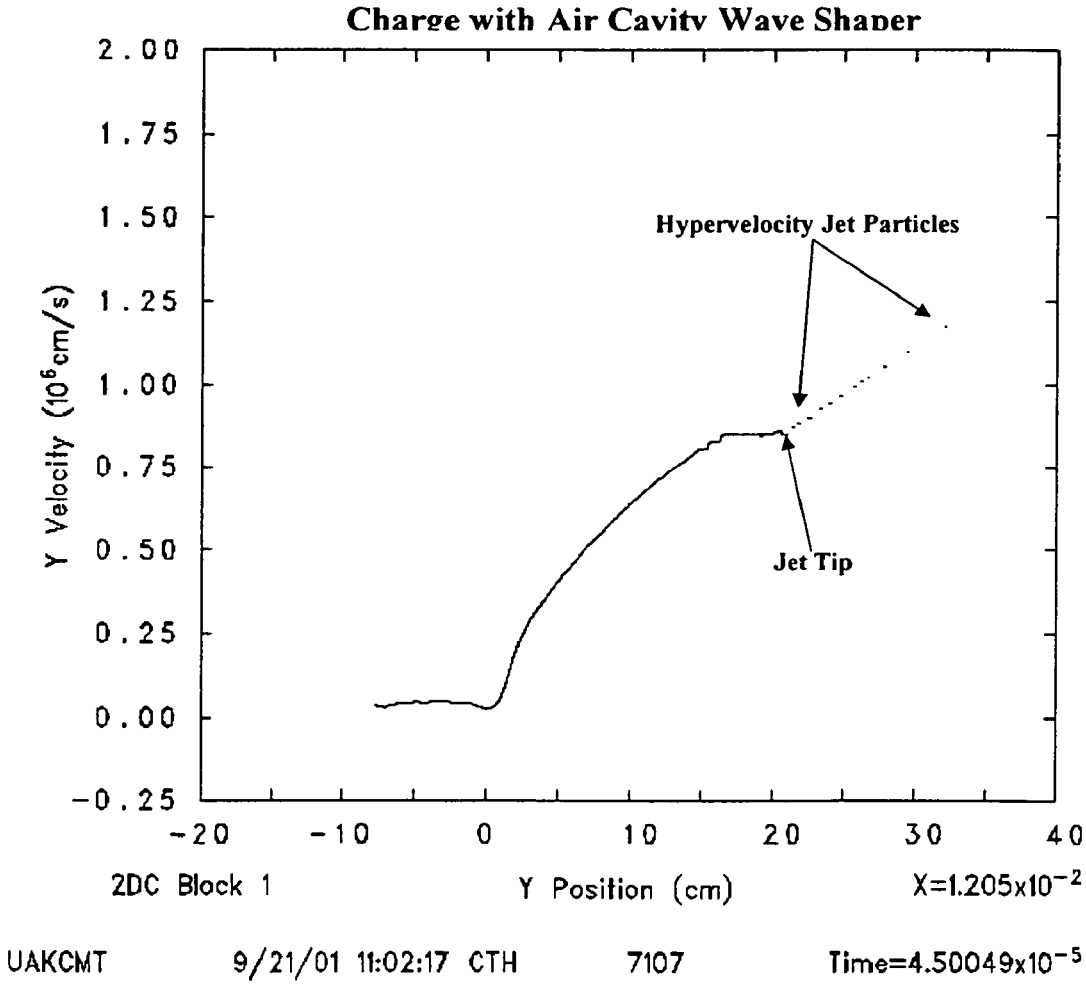
FIG. 8 is a computer simulation of a velocity profile of the jet formation resulting from detonation of the device shown in FIG. 6.
Figure 9:
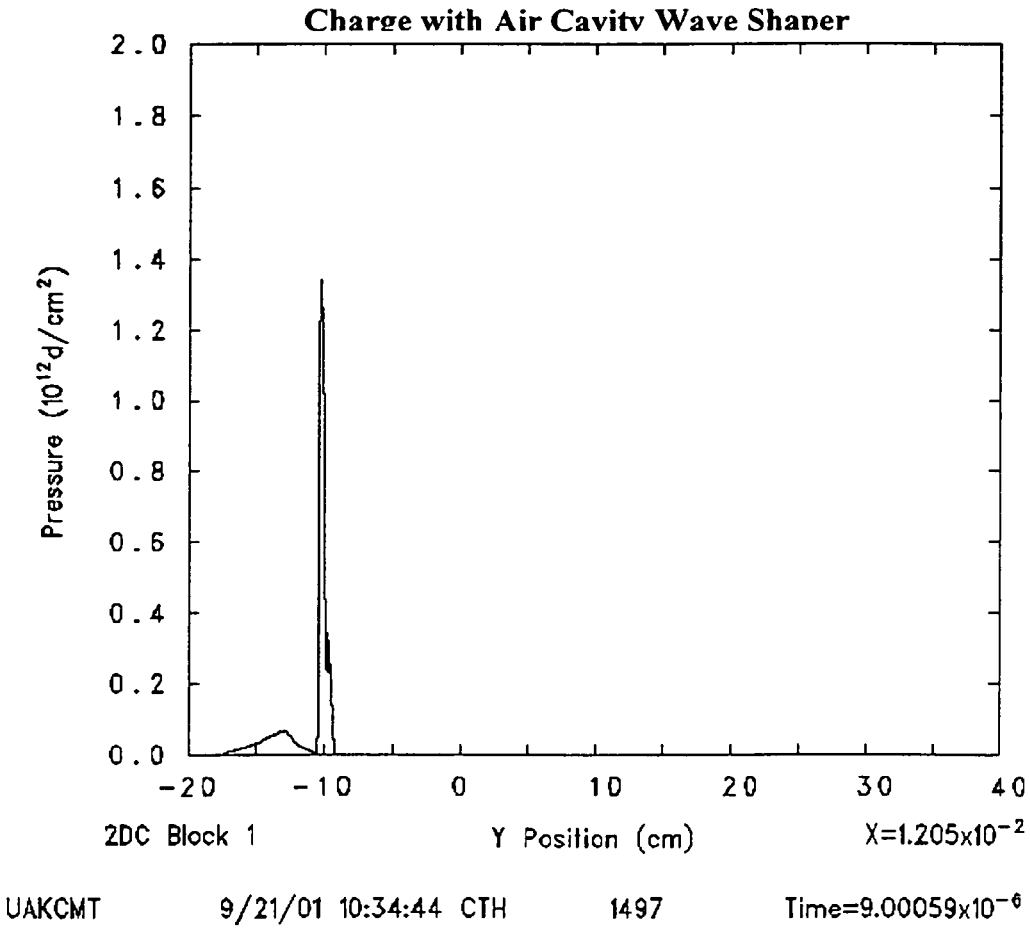
FIG. 9 is a computer simulation of a pressure profile of the jet formation resulting from detonation of the device shown in FIG. 6.

FIGS. 7–9 are plots generated in the CTH simulation of jet formation for a device like that in FIG. 6. The actual dimensions of the elements shown in FIG. 6 and used in the calculations of the simulation are as follows. The air-filled conical cavity has an angle (B) of about 37 degrees and a width (W1) of 4.25 cm. The other dimensions, for the liner 15 and body of explosive material 13 remain the same as in the simulation for a device like that in FIG. 1. 5% less explosive is used in the calculation as compared to the simulation for the device of FIG. 1; i.e., a 1.29 kg charge is used. FIG. 7 is a two dimensional plot, measuring the length and width from the open end of the liner, of the jet formed in space 45 microseconds after initiation of the detonation. FIG. 8 illustrates that the hypervelocity jet particles depicted in FIG. 7 move at a velocity of about 12 km/s, and the jet tip velocity has increased to about 9 km/s, as compared to the velocity profile produced by the shaped charge explosive device of FIG. 1. Further, in a pressure profile at 9 microseconds, similar to that shown in FIGS. 4 and 5, FIG. 9 illustrates that the jet particles depicted in FIG. 7 exhibit a peak pressure of about $1.35\times10^{12}$ d/cm$^2$, as compared to the profile produced by the shaped charge explosive device of FIG. 1.

Figure 10:
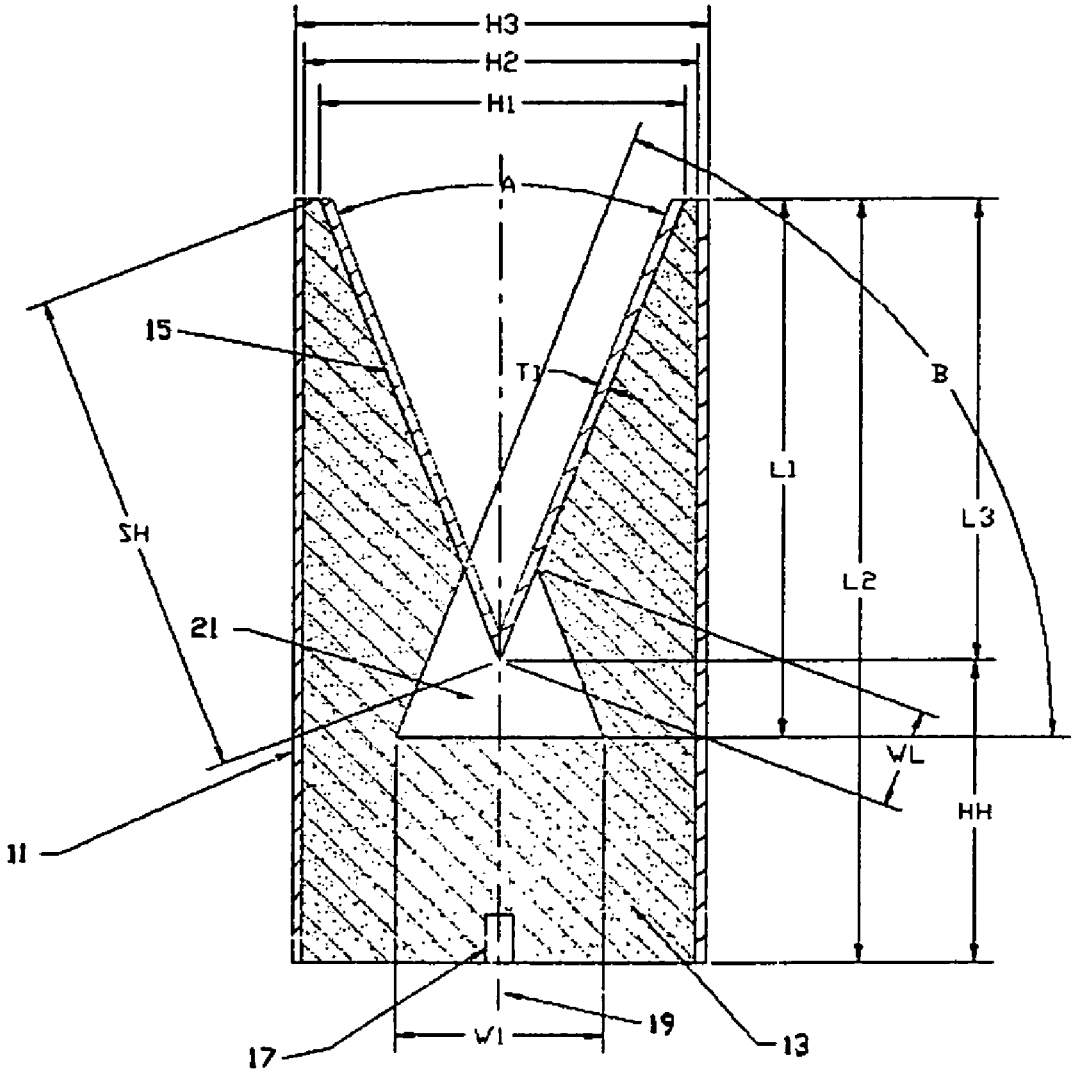
FIG. 10 is a diametral cross-sectional view of one embodiment of the shaped charge explosive device according to the present invention provided with a gas-filled wave shaper cavity that overlaps the liner.
Figure 11:
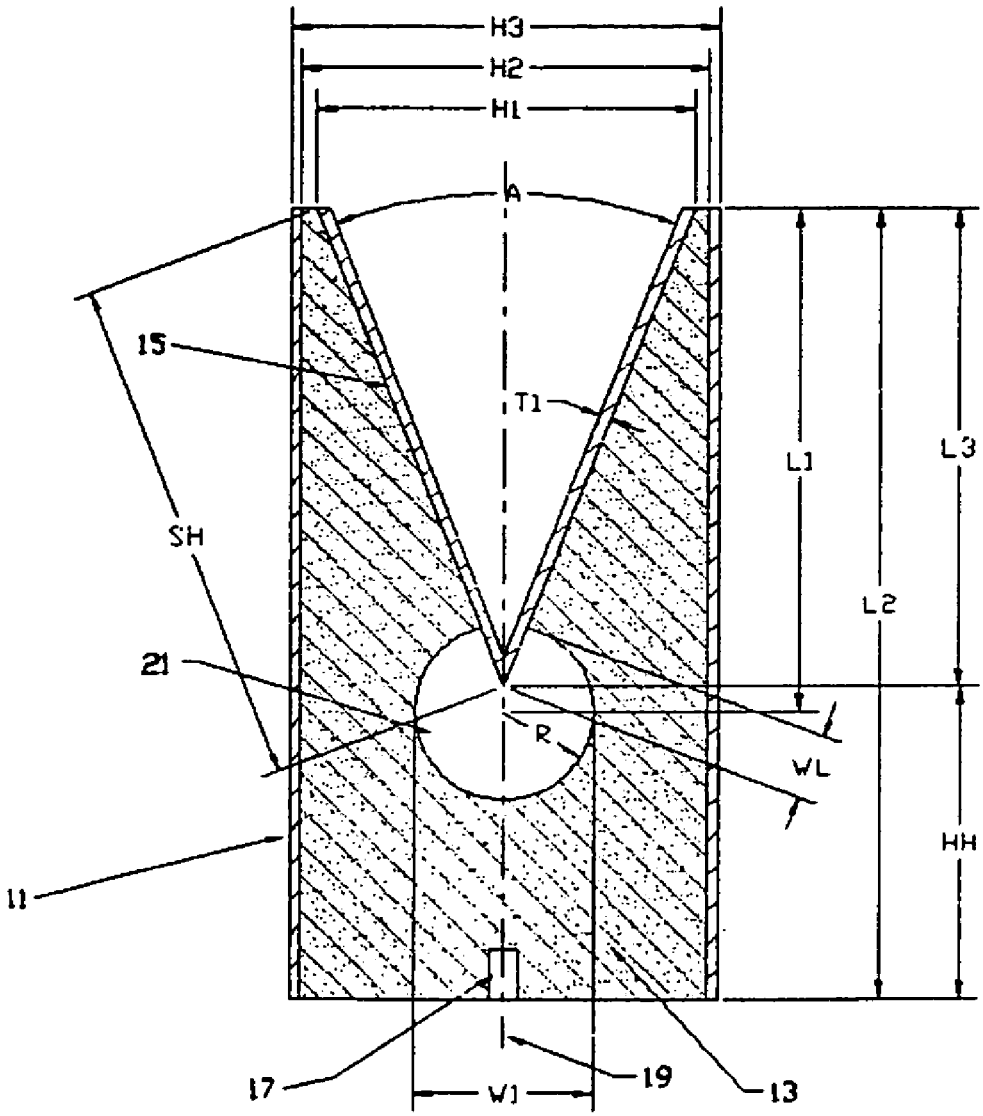
FIG. 11 is a diametral cross-sectional view of another embodiment of the shaped charge explosive device according to the present invention provided with a second configuration of a gas-filled wave shaper cavity that overlaps the liner.
Figure 12:
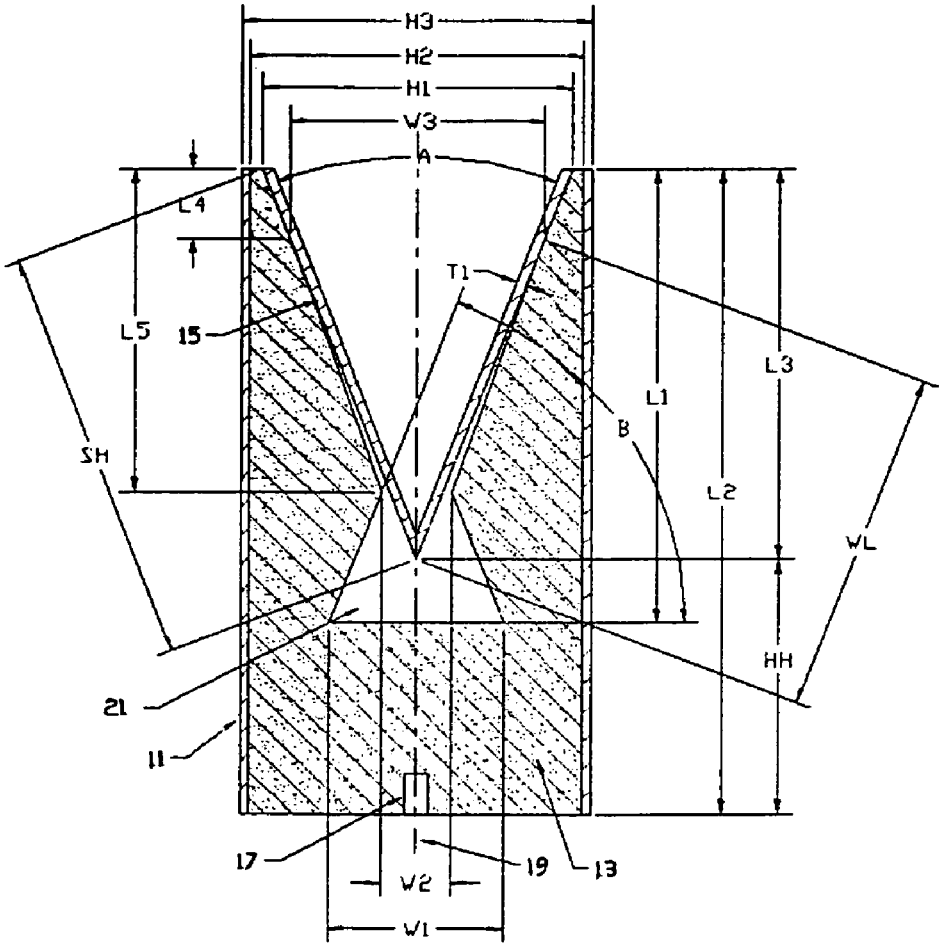
FIG. 12 is a diametral cross-sectional view of another embodiment of the shaped charge explosive device according to the present invention provided with a third configuration of a gas-filled wave shaper cavity that overlaps the liner.

FIGS. 10, 11 and 12 show three different embodiments of the improved shaped charge explosive device of the invention. The devices shown differ from the prior art device of FIG. 1 by the inclusion of a wave shaper in the form of a gas-filled cavity 21 surrounding the apex of the liner 15 whereby the detonation wave which is formed upon detonation of the explosive charge undergoes reshaping closer to the liner and compresses the gas of the gas-filled cavity wave shaper to a higher pressure after detonation than can be realized by conventional air cavity wave shapers, such as that shown in FIG. 6. This higher pressure translates into a higher kinetic energy, and thus velocity, of the jet tip region.

Although the exact geometry and orientation of the gas-filled cavity 21 is variable depending on the application intended, in each instance the cavity subtends or encircles a portion of the liner 15 including at least the apex (WL) of the liner. This includes those instances in which the axis of the cavity 21 may be so arranged as to intersect or be parallel to, rather than be coaxial with, the axis of the liner 15. Preferably, however, the axis of the gas-filled cavity 21 is coaxial with the axis of the liner 15 and has a hollow spherical shape (FIG. 11) an "hour-glass" configuration, i.e., two hollow frustoconical or truncated conical shapes joined at their apex portions (FIG. 12) or a hollow frustoconical or truncated conical shape (FIG. 10), most preferably the latter. Thus, in each of these preferred embodiments, the cavity is disposed coaxially with respect to the casing 11 (or body of explosive material 13 when a casing is not employed) and the liner 15, intermediate the apex portion (WL) of the liner and the body of explosive material, such that the cavity subtends or overlaps the liner.

In the most preferred wave shaper (FIG. 10), the truncated narrow end of the hollow frustoconical wave cavity 21 faces toward and subtends or encompasses the apex of the liner 15. The wider or base end of the hollow frustoconical cavity 21 faces the bottom or rearward end of the casing 11 and the detonator 17 and has a width or diameter (W1) that varies from about 0.1·H2 to about H1, preferably from about 0.25·H2 to about 0.5·H2. The values for (W1) corresponding to the diameter of the spherical cavity and the base of the hour-glass shaped cavity of the devices illustrated in FIGS. 11 and 12, respectively, have the same values as (W1) in the embodiment of FIG. 10, discussed immediately above. The exact volume of the gas-filled cavity is variable depending on the application desired. However, the volume typically occupied by the gas-filled cavity 21 of the invention ranges from about 1 to about 50% of the total volume of the shaped charge explosive device not occupied by the liner 15 or the gas-filled cavity. The length of the portion of the slant height, (SH), of the liner 15 subtended by the cavities 21 of FIGS. 10, 11 and 12 (from which the volume of that portion of the conical liner subtended by the cavity can be calculated) is designated by (WL) in FIGS. 10, 11 and 12 and has a value for the preferred wave shapers of FIGS. 10 and 11 of about 0.1 to about 0.5 times the slant height of the liner, preferably about 0.1 to about 0.3 times the slant height of the liner 15, and for the wave shaper of FIG. 12 of about 0.1 to about 0.75 times the slant height of the liner.

When the wave shaper employed is the preferred frustoconical air-filled cavity of FIG. 10, or the hour glass configuration of FIG. 12, angle (B) is equivalently formed by the preferably planar base in the body of explosive material 13 (and which is preferably parallel to the rearward or bottom end of the casing 11) and the conical side of the cavity, and the slant height of the liner ranges from about 10° to about 85°, preferably from about 45° to about 75°.

Air is the preferred gas for use in the cavity 21 because it performs well, is readily available, and is inexpensive. Other than air, gases which are suitable for use in the invention are generally relatively low density gases such as nitrogen, helium, or argon. The gas introduced into the wave shaper of the invention may be at or above atmospheric pressure.

Depending on the method of assembly, gas may be introduced into the cavity 21 at some intermediate step of assembly, at the end of assembly or after completion of assembly and prior to use. For example, for an air-filled cavity in which the air within the cavity is to be at atmospheric or ambient conditions, conventional production or assembly methods may be employed. However, when above ambient pressures or gases other than air are used in the cavity (discussed below), other methods or modified methods are generally preferable. Thus, the shaped charge explosive device of the invention could be assembled in an environment in which pressure or the gaseous composition of the environment is carefully controlled. In this method, the enclosed cavity of the shaped charge explosive device would be formed only after at least two parts of the shaped charge explosive device having concave portions configured as a part of the wave shaper cavity are joined, typically by conventional means. Alternatively, one or more bore holes could be formed leading from the exterior of the shaped charge explosive device of the invention to the interior of the cavity such that air is either displaced by, or evacuated before admission of, another gas used to fill the cavity at the desired pressure. Depending on the characteristics of the explosive charge, such bore holes could be formed by inserting narrowly constricted, hollow, rigid tubing, such as metallic tubing, or a syringe tip, through the explosive charge material. The bore hole or holes could then be sealed after introduction of the gas.

Although preferred, a casing 11 is not essential to the performance of the shaped charge explosive device of the invention and can be dispensed with. Typically, when present, the casing 11 is formed from a metal, such as steel or aluminum or a composite material, cardboard, or the like. While various configurations (such as tapered or boat-tailed configurations) may be used for the casing 11, preferably, it has an axially or rotationally symmetrical shape and, most preferably, a cylindrical configuration. While the particular dimensions of the shaped charge explosive device of the invention and the casing 11 vary with the specific application contemplated and particularly the size of the explosive charge required, the width or outer diameter of the body of explosive material (H2), as indicated in FIG. 10 is generally about 0.4 to 200 cm. The thickness of the casing 11 is one-half of (H3), the overall width or diameter of the casing of the shaped charge explosive device of the invention, minus (H2) and is generally thin. For example with bodies of explosive material nominally 12.5 cm in diameter the thickness of an aluminum casing is 0.25 cm. For other values of the diameter (H2), the thickness of the casing will be about the same or approximately proportional to this value. The length (L2) of the casing 11 (or body of explosive material 13 when no casing is used) is the sum of the altitude of the cone (L3) and the head height of explosive, designated as (HH) in FIG. 10. The head height may vary from (H2) to (H1)/4.

When used as a warhead, the casing 11 may be fitted with a frontal ogive (not shown) enclosing the forward end of the warhead and extending a distance ahead of the casing 11 and the liner 15 to provide a forward aerodynamic enclosure as well as a built-in standoff distance. A rear aerodynamic enclosure (not shown) may also be included depending on the method of delivering the weapon. If the shaped charge explosive device of the invention is used for industrial purposes, specific modifications (not shown) may be included forward of the liner 15.

As the body of explosive material 13, any conventional explosive material employed in shaped charge explosive devices may be used in the present invention. Preferably, the body of explosive material 13 is disposed rotationally symmetrically and, when present, coaxially within the casing 11. The shape of the body of explosive material 13 is normally determined by the shapes of the casing 11 (when present), the liner 15, and the cavity 21. Thus, in the present invention, when the body of explosive material 13 is formed in a cylindrical shape, or within a casing, with a simple conical forward end, it conforms to this shape.

The explosive is normally cast as a flowable fluid which, after curing, becomes a substantially solid mass. Alternately, the explosive may be pressed in a mold or into a casing. The use of casting or pressing techniques depends on the explosive used. The bottom of cast explosive may be machined in order to provide the proper shape to mate with the detonator. Generally, the ability of a shaped charge explosive device to penetrate a target material, such as armor, hard rock, etc., arises from the distance from the base of the charge to the target, the liner employed and, in most instances when present, a wave shaper.

In the invention, the liner 15 is typically formed from known liner materials such as glass, plastic, or metals such as aluminum, tantalum, tungsten, depleted uranium, gold, silver, copper, molybdenum, hafnium, zinc, magnesium, lead, cadmium, platinum, beryllium, titanium, and alloys derived from the aforementioned elements. Preferably, the liner is formed from copper, but may include non metals such as plastics or ceramics. Although the preferred configuration of the liner is an axially symmetrical hollow right circular cone having an open base end, as shown in FIG. 10, other configurations such as hemispheres, paraboloids, ellipsoids, pear shapes, tulip shapes, trumpet shapes, pyramids and linear cutting charges also may be employed. When the preferred hollow, conical configuration is employed, angle (A), formed within the apex of the conical liner, is about 20 to about 120°, preferably about 30 to about 60°, and most preferably about 35 to about 50°.

The liner 15 includes a forward perimeter or base (indicated by the limit lines of (H1) in FIG. 10) opening forward toward the open forward end of the casing 11 and an apex (indicated by the limit lines of (WL) in FIG. 10). In the embodiment shown in FIG. 10, the base of the liner 15 lies in the same plane as the open outer end of the casing 11 (or, when a casing is not used, the open outer end of the body of explosive material 13). The base of the liner 15 has a width or outside diameter (H1) ranging from about 0.8 to about 1.0 times (H2). When the dimensions of (H2) are as indicated above, then the diameter (H1) is about 0.32 cm to 200 cm, depending on the value of (H2). The altitude or height of the liner, (L3) is:

$$H1/(2\cdot\tan A/2).$$

The slant height of the conical liner, i.e., the length of the wall of liner 15 from base to apex, is:

$$H1/(2\cdot\sin A/2).$$

The head height of the shaped charge explosive device, (HH), is (L2) minus the altitude of the liner, (L3). The thickness of the liner (T1) may be uniform or vary; namely, depending upon the application, the liner may be thick at the apex and thin at the base or vice versa. The range of wall thicknesses may vary from 0.5% to 10% of the charge diameter (H2). The preferred values are about 1 to about 3% of (H2). The optimum range is about 2 to about 3% of (H2).

Figure 13:
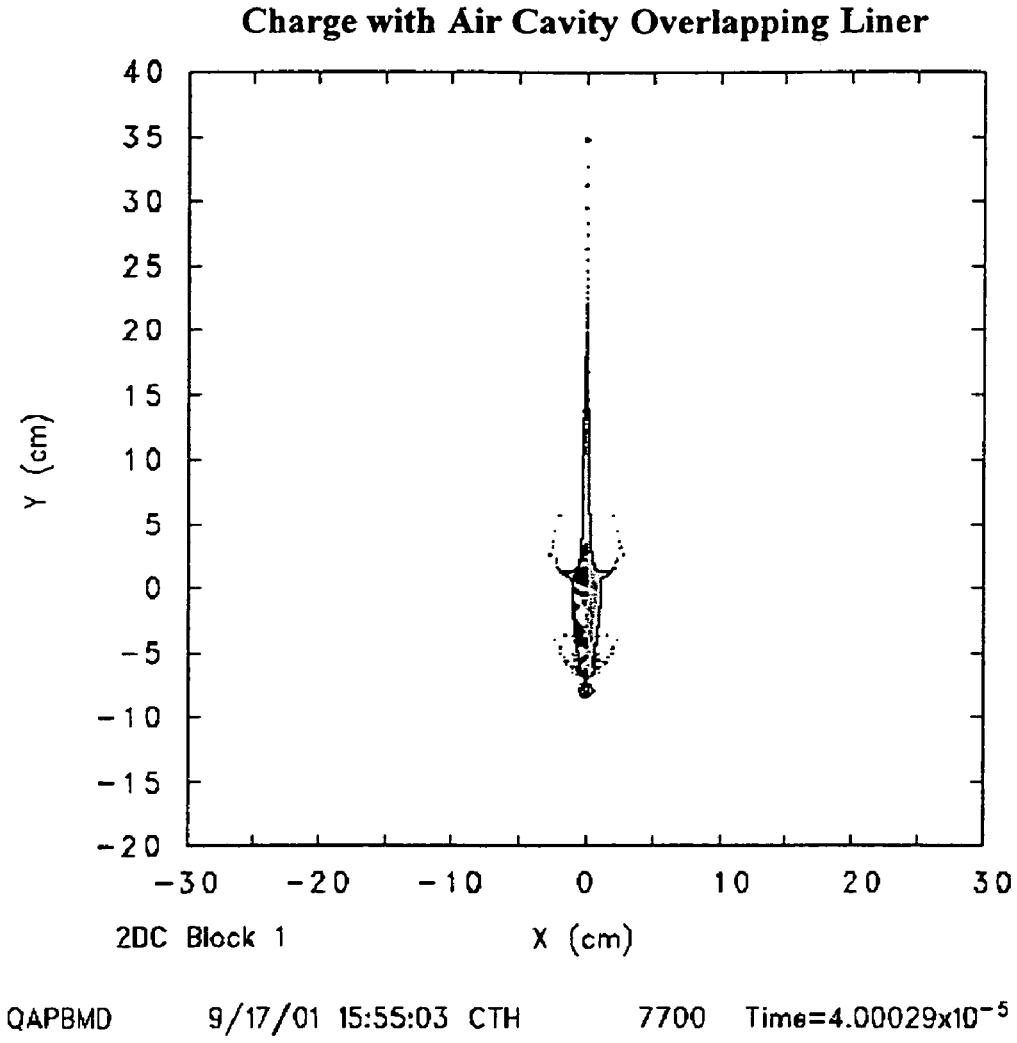
FIG. 13 is a computer simulation of a jet formation resulting from detonation of the device shown in FIG. 10.
Figure 14:
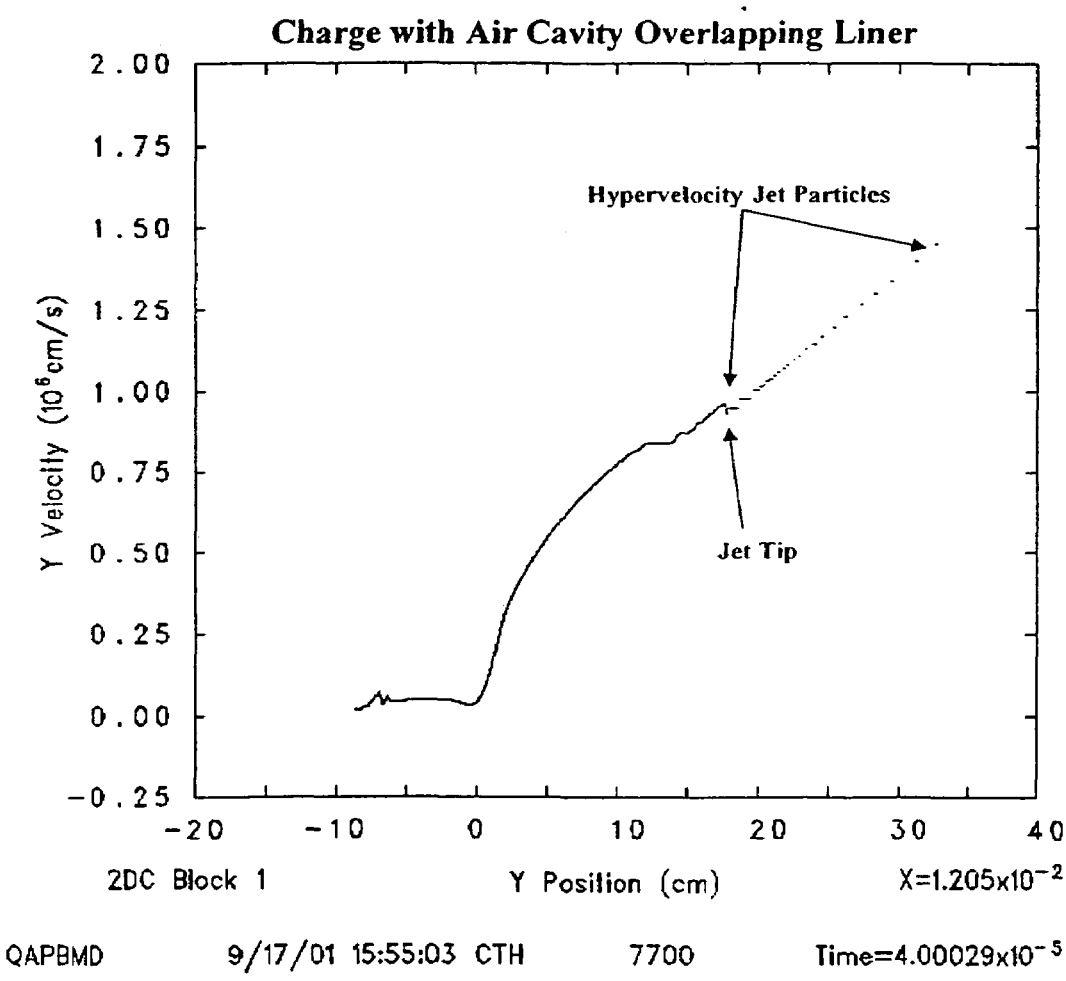
FIG. 14 is a computer simulation of a velocity profile of the jet formation resulting from detonation of the device shown in FIG. 10.
Figure 15:
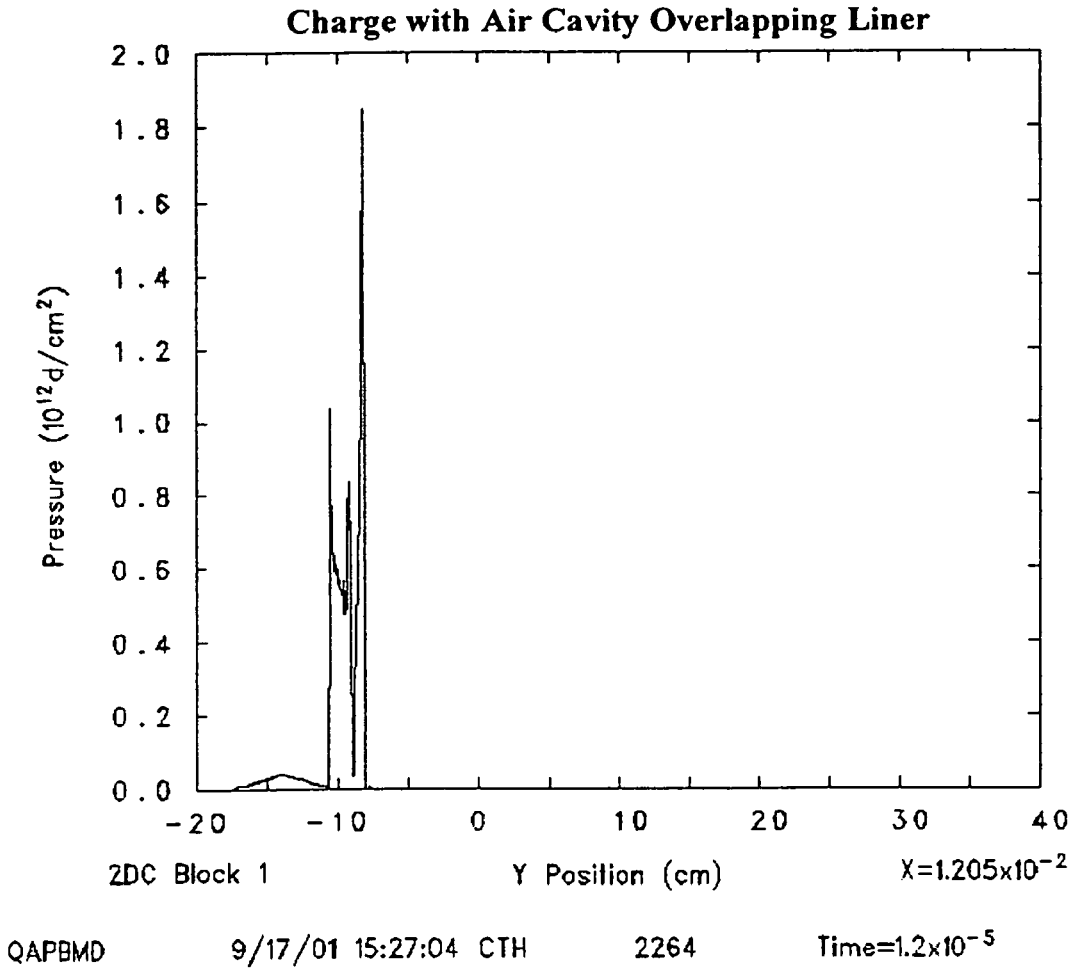
FIG. 15 is a computer simulation of a pressure profile at 12 microseconds of the jet formation resulting from detonation of the device shown in FIG. 10.

FIGS. 13–15 are plots generated in the CTH simulation of jet formation for a device like that in FIG. 10. The actual dimensions of the elements shown in FIG. 10 and used in the calculations of the simulation are as follows: The cavity has a width (W1) at its base equal to 4.25 cm and an angle B of 69 degrees. The gas is air at ambient pressure. The amount of explosive used is 10% less than used in the simulation for the device of FIG. 1; i.e., a 1.22 kg charge is used. The other dimensions remain the same as in the simulation for a device like that in FIG. 1. FIG. 13 shows the CTH simulation of a jet formation at 40 microseconds. FIG. 14 illustrates that the hypervelocity jet particles depicted in FIG. 13 move at a velocity of about 15 km/s, and the main jet tip velocity has increased to about 10 km/s, as compared to the profile produced by the prior art shaped charge explosive devices of FIGS. 1 and 6. FIG. 15 shows the pressure profile at 12 microseconds, which is the maximum pressure observed, namely, $1.9\times10^{12}$ d/cm$^2$. The width of the pressure pulse illustrated in FIG. 15 is greater than for the prior art devices of FIGS. 1 and 6.

As noted above the higher pressure, higher kinetic energy, and increased velocity of the jet tip region obtained by the shaped charge explosive device of the invention, compared to conventional wave shapers, are attributable to several factors. These include a gas-filled cavity functioning as a wave shaper and the particular placement of the gas-filled cavity surrounding or subtending the apex of the liner whereby the detonation wave surrounding the gas-filled cavity undergoes reshaping closer to the liner and compresses the gas of the gas-filled cavity wave shaper to a higher pressure after detonation than can be realized by conventional wave shapers, including conventional air cavity wave shapers.

It is obvious that many modifications and variations of the present invention are possible in light of the above teachings. It is, therefore, to be understood that within the scope of the appended claims, the invention may be practiced otherwise than as described.

What is claimed as new and desired to be secured by Letters Patent of the United States is:

1. A shaped charge explosive device comprising:

an axially symmetric body of explosive material having a forward end and a rear end;

a liner lining the forward end of the body, the liner having an apex lying along the symmetry axis of the body;

a detonator disposed at the rear end of the body for detonating the explosive material to produce a detonation wave to collapse the liner into a plurality of parts and project the liner parts against an external target; and a cavity formed in the forward end of the body, the cavity having a base portion defined by the explosive material that is substantially parallel to the rear end of the body, and the cavity having wall portions defined by the explosive material that extends from the base portion to the liner, and the apex of the liner projects into the cavity so that the cavity overlaps the apex of the liner.

2. The shaped charge explosive device of claim 1, wherein the liner is a conical liner.

3. The shaped charge explosive device of claim 1, wherein the cavity has a frustoconical configuration with a truncated apex and a flat base portion, the truncated apex facing and overlapping the apex of the liner and the base portion facing the rear end of the explosive material body.

4. The shaped charge explosive device of claim 1, wherein the cavity is arranged coaxially with respect to the symmetry axis of the explosive charge body.

5. The shaped charge explosive device of claim 1, wherein the cavity is filled with air, nitrogen, helium, or argon.

6. The shaped charge explosive device of claim 1, wherein the cavity is filled with air.

7. The shaped charge explosive device of claim 1, wherein the cavity is filled with a gas at or above atmospheric pressure.

8. The shaped charge explosive device of claim 1, wherein the liner has a conical shape and the base of the conical liner defines a plane that is perpendicular to the symmetry axis.

9. The shaped charge explosive device of claim 1, wherein the base portion of the cavity has a width that is from about one-fourth to about one-half the width of the body of explosive material, the cavity has a volume of from about 10% to about 50% of the volume of the shaped charge, and the length of the portion of the liner that is overlapped by the cavity is from about 10% to about 50% of the length of the surface of the liner.

10. The shaped charge explosive device of claim 9, wherein the liner is a conical liner.

11. The shaped charge explosive device of claim 9, wherein the cavity has a frustoconical configuration with a truncated apex and a base portion, the truncated apex facing and overlapping the apex of the liner and the base portion facing the rear end of the explosive material body.

12. The shaped charge explosive device of claim 9, wherein the cavity is arranged coaxially with respect to the symmetry axis of the explosive charge body.

13. The shaped charge explosive device of claim 9, wherein the cavity is filled with air, nitrogen, helium, or argon.

14. A shaped charge explosive device comprising:

an axially symmetric body of explosive material having a forward end and a rear end;

a liner lining the forward end of the body, the liner having an apex lying along the symmetry axis of the body;

a detonator disposed at the rear end of the body for detonating the explosive material to produce a detonation wave to collapse the liner into a plurality of parts and for projecting the liner parts against an external target; and a cavity formed in the forward end of the body, wherein the walls of the cavity overlap the apex of the liner for shaping a detonation wave produced upon detonation of the explosive material so that the wave impacts the liner to transfer energy to the liner and to maximize the effective penetration of the external target by the projected liner parts, wherein the volume of the cavity is from about 1% to about 50% of the volume of the explosive material, wherein the length of the wall portion of the liner that is overlapped by the cavity is from about 10% to about 75% the slant height of the liner, and wherein the angle of the apex of the conical liner is from about 20 degrees to about 120 degrees, wherein the cavity overlaps a portion of the apex of the hollow liner equivalent to about 1% to about 50% of the total volume of the conical liner, wherein the cavity has a frustoconical shape with a base portion having walls that converge from the base portion to the apex of the liner.

15. The shaped charge explosive device of claim 14, wherein the length of the wall portion of the liner that is overlapped by the cavity is from about 10% to about 30% of the slant height of the liner.

16. The shaped charge explosive device of claim 14, wherein the angle of the apex of the conical liner is from about 35 degrees to about 50 degrees.

17. The shaped charge explosive device of claim 14, wherein the cavity has a truncated apex facing frustoconical configuration with a truncated apex and a base, the truncated apex facing and overlapping the apex of the liner and the base facing the explosive material body, wherein the wall surfaces of the truncated apex of the cavity form angles of from about 10 degrees to about 85 degrees with the base of the cavity.

18. The shaped charge explosive device of claim 17, wherein the wall surfaces of the truncated apex of the cavity form angles of from about 45 degrees to about 75 degrees with the base of the cavity.

19. The shaped charge explosive device of claim 14, wherein the width of the explosive charge is from about 0.4 to about 200 centimeters.

20. The shaped charge explosive device of claim 14, wherein the cavity is filled with air, nitrogen, helium, or argon.

21. The shaped charge explosive device of claim 20, wherein the cavity is filled with air.

22. The shaped charge explosive device of claim 14, wherein the cavity is filled with a gas at or above atmospheric pressure.

23. The shaped charge explosive device of claim 14, further comprising a hollow cylindrical housing surrounding the explosive material to contain the explosive material body, liner, detonator and cavity, and wherein the cylindrical housing has an axis disposed coaxially with respect to an axis of symmetry of the explosive material body.

* * * * *